US010312669B2

(12) United States Patent
Sumoyama et al.

(10) Patent No.: US 10,312,669 B2
(45) Date of Patent: Jun. 4, 2019

(54) SPARK PLUG

(71) Applicant: NGK SPARK PLUG CO., LTD., Nagoya-shi, Aichi (JP)

(72) Inventors: Daisuke Sumoyama, Nagoya (JP); Tatsuya Gozawa, Komaki (JP); Tsutomu Shibata, Owariasahi (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/072,425

(22) PCT Filed: Oct. 17, 2016

(86) PCT No.: PCT/JP2016/004601
§ 371 (c)(1),
(2) Date: Jul. 24, 2018

(87) PCT Pub. No.: WO2017/130247
PCT Pub. Date: Aug. 3, 2017

(65) Prior Publication Data

US 2018/0366918 A1 Dec. 20, 2018

(30) Foreign Application Priority Data

Jan. 26, 2016 (JP) ..... 2016-012657

(51) Int. Cl.
*H01T 13/39* (2006.01)
*C22C 5/04* (2006.01)
(Continued)

(52) U.S. Cl.
CPC ..... *H01T 13/39* (2013.01); *C22C 5/04* (2013.01); *C22C 30/00* (2013.01); *H01T 13/20* (2013.01); *H01T 13/32* (2013.01); *H01T 21/02* (2013.01)

(58) Field of Classification Search
CPC ..... H01T 13/20
See application file for complete search history.

(56) References Cited

U.S. PATENT DOCUMENTS 4,540,910 A 9/1985 Kondo et al.
5,465,022 A * 11/1995 Katoh ..... H01T 13/39 313/142

(Continued)

FOREIGN PATENT DOCUMENTS

CN 202495679 U 10/2012
JP S59-094391 5/1984

(Continued)

OTHER PUBLICATIONS

International Search Report from corresponding International Patent Application No. PCT/JP16/04601, dated Nov. 22, 2016.

*Primary Examiner* — Donald L Raleigh
(74) *Attorney, Agent, or Firm* — Kusner & Jaffe

(57) ABSTRACT

An electrode base material of the spark plug contains not less than 50 wt. % of Ni. A discharge member contains not less than 45 wt. % of Pt, and at least one of Ni and Rh. An intermediate member contains Pt and Ni. In the discharge member, a content of Pt is highest, and a total content of Pt, Rh, and Ni is not less than 92 wt. %. In the intermediate member, a content of one of Pt and Ni is not less than 50 wt. %, a content of Ni is higher than a content of Ni in the discharge member, and a total content of Pt, Rh, and Ni is not less than 85 wt. %. A thickness of the diffusion layer formed between the discharge member and the intermediate member is not less than 0.002 mm and not more than 0.065 mm.

7 Claims, 4 Drawing Sheets

(51) Int. Cl.

| | |
|---|---|
| ***H01T 13/20*** | (2006.01) |
| ***C22C 30/00*** | (2006.01) |
| ***H01T 13/32*** | (2006.01) |
| ***H01T 21/02*** | (2006.01) |

(56) References Cited

U.S. PATENT DOCUMENTS

| | | | | |
|---|---|---|---|---|
| 5,488,262 | A | 1/1996 | Takamura | |
| 2006/0213474 | A1* | 9/2006 | Sugiyama | H01T 13/20 123/169 EL |
| 2011/0198981 | A1 | 8/2011 | Kishimoto et al. | |
| 2014/0184054 | A1 | 7/2014 | Nomura et al. | |
| 2014/0265813 | A1* | 9/2014 | Kowalski | H01T 13/32 313/141 |
| 2017/0063048 | A1 | 3/2017 | Gozawa et al. | |

FOREIGN PATENT DOCUMENTS

| | | | |
|---|---|---|---|
| JP | H05-166577 | | 7/1993 |
| JP | H06-060959 | | 3/1994 |
| JP | B2-5092012 | | 9/2012 |
| JP | 2017-020129 | A | 3/2017 |
| JP | 2017-050129 | A | 3/2017 |
| WO | WO 2013/015262 | A1 | 1/2013 |

* cited by examiner

COMPARATIVE SAMPLE

SPARK PLUG

RELATED APPLICATIONS

This application is a National Stage of International Application No. PCT/JP16/04601 filed Oct. 17, 2016, which claims the benefit of Japanese Patent Application No. 2016-012657, filed Jan. 26, 2016, the entire contents of which are incorporated herein by reference.

FIELD OF THE INVENTION

The disclosure of the present specification relates to a spark plug used in an internal combustion engine or the like.

BACKGROUND OF THE INVENTION

A noble metal including platinum (Pt) is known to be used as an electrode of a spark plug used in an internal combustion engine. For example, in the spark plug disclosed in Japanese Patent Application Laid-Open (kokai) No. H06-60959, a discharge member formed from platinum or a platinum-iridium alloy is bonded to an electrode base material via an intermediate member formed from a platinum-nickel alloy. A diffusion layer is formed between the discharge member and the intermediate member. This suppresses peeling or falling off of the discharge member due to thermal stress between the members.

However, in recent years, in order to further improve fuel economy, the temperature within a combustion chamber of an internal combustion engine needs to be further increased, and a spark plug needs to operate under a higher-temperature environment. Under such a high-temperature environment, since wear of a discharge member due to spark, oxidation, or the like, and peeling of a discharge member due to thermal stress or the like, are more likely to occur, wear resistance and peeling resistance need to be further improved.

For example, in the spark plug disclosed in Japanese Patent Application Laid-Open (kokai) No. H06-60959, platinum or a platinum-iridium alloy is used as a discharge member, and a platinum-nickel alloy is used as an intermediate member. However, under the above-described high-temperature environment, there is a possibility of embrittlement and decrease in thermal conductivity due to increase of elements in the diffusion layer and Kirkendall voids that occur due to progressing of interdiffusion between the discharge member and the intermediate member. In addition, for example, when platinum is used as a discharge member, crystal grains are likely to grow in platinum and intercrystalline cracking is likely to occur. Since high-temperature combustion atmosphere is likely to reach the vicinity of an interface with the diffusion layer due to the intercrystalline cracking, diffusion may progress and intercrystalline cracking may be thus increased. Therefore, peeling resistance and wear resistance are likely to decrease. When a platinum-iridium alloy is used as a discharge member, oxidation wear of iridium is likely to occur under a high-temperature environment, and the diffusion layer is likely to be embrittled due to iridium and nickel being mixed in the diffusion layer. Since iridium is reduced due to oxidation, crystal grains on the surface of the discharge member gradually grow as seen in platinum, and the crystal grains fall off as in the case of platinum. As a result, under the high-temperature environment, temperature is likely to increase in the vicinity of an interface between the discharge member and the diffusion layer, diffusion may progress, and the wear resistance and peeling resistance of a spark plug may be decreased.

The present specification discloses a spark plug that can achieve both wear resistance and peeling resistance of a spark plug under a high-temperature environment.

SUMMARY OF THE INVENTION

Application Example 1

In accordance with a first aspect of the present invention, there is provided a spark plug comprising:

a center electrode extending in an axial direction; and a ground electrode forming a gap between the ground electrode and the center electrode, wherein at least one of the center electrode and the ground electrode includes:

an electrode base material;

a discharge member having a discharge surface that forms the gap;

an intermediate member disposed between the discharge member and the electrode base material; and a diffusion layer formed between the discharge member and the intermediate member, the electrode base material contains not less than 50 wt. % of nickel (Ni), the discharge member contains not less than 45 wt. % of platinum (Pt), and at least one of nickel and rhodium (Rh), the intermediate member contains platinum and nickel, in the discharge member, a content of platinum is highest, and a total content of platinum, rhodium, and nickel is not less than 92 wt. %, in the intermediate member, a content of one of platinum and nickel is not less than 50 wt. %, a content of nickel is higher than a content of nickel in the discharge member, and a total content of platinum, rhodium, and nickel is not less than 85 wt. %, and a thickness of the diffusion layer is not less than 0.002 mm and not more than 0.065 mm.

According to the above-described structure, it is possible to achieve improvement of oxidation resistance of the discharge member, suppression of progressing of interdiffusion between the discharge member and the intermediate member, decrease in thermal stress, suppression of embrittlement of the diffusion layer, and suppression of decrease in thermal conductivity of the diffusion layer. As a result, it is possible to achieve both wear resistance and peeling resistance in the spark plug.

Application Example 2

In accordance to a second aspect of the present invention, there is provided a spark plug, as described in the application example 1, wherein, the thickness of the diffusion layer is not less than 0.005 mm and not more than 0.065 mm.

According to the above-described structure, since it is thus possible to more effectively suppress peeling between the discharge member and the intermediate member due to thermal stress, it is possible to further improve peeling resistance and wear resistance in a spark plug 100.

Application Example 3

In accordance with a third aspect of the present invention, there is provided a spark plug, as described in the application example 1 or 2, wherein in the case where D1 represents a distance between the diffusion layer and the discharge surface of the discharge member, and G represents a length of the gap, D1≥0.1 mm and (D1/G)≥0.1 are satisfied.

Thus, it is possible to further suppress progressing of interdiffusion between the discharge member and the intermediate member.

Application Example 4

In accordance with a fourth aspect of the present invention, there is provided a spark plug, as described in any of the application examples 1 to 3, wherein in the discharge member, a total content of platinum, rhodium, and nickel is not less than 96 wt. %.

Thus, by further decreasing the components other than platinum, rhodium, and nickel in the discharge member, it is possible to further suppress embrittlement of the diffusion layer and decrease in thermal conductivity of the diffusion layer.

Application Example 5

In accordance with a fifth aspect of the present invention, there is provided a spark plug, as described in any of the application examples 1 to 4, wherein in the intermediate member, a total content of platinum, rhodium, and nickel is not less than 96 wt. %.

Thus, by further decreasing the components other than platinum, rhodium, and nickel in the intermediate member, it is possible to further suppress the embrittlement of the diffusion layer and decrease in thermal conductivity of the diffusion layer as described above.

Application Example 6

In accordance with a sixth aspect of the present invention, there is provided a spark plug, as described in any of the application examples 1 to 5, wherein a content of nickel in the intermediate member is higher than a content of nickel in the discharge member by not less than 2.5 wt. %.

Thus, since it is possible to more effectively decrease thermal stress generated between the intermediate member and the electrode base material, it is possible to further improve peeling resistance of a discharge member 351.

Application Example 7

In accordance with a seventh aspect of the present invention, there is provided a spark plug, as described in the application example 4, wherein, in the discharge member, a total content of platinum and rhodium is not less than 88 wt. %.

Thus, by decreasing, in the discharge member, the component other than platinum superior in wear resistance and rhodium which allows suppression of grain growth of platinum, it is possible to further improve wear resistance of the spark plug.

It is noted that the technique disclosed in the present specification can be implemented in various forms. For example, the technique may be implemented as a spark plug, an ignition device using the spark plug, an internal combustion engine to which the spark plug is mounted, and an electrode for the spark plug, and the like.

DETAILED DESCRIPTION OF THE INVENTION

A. Embodiment

Figure 1:
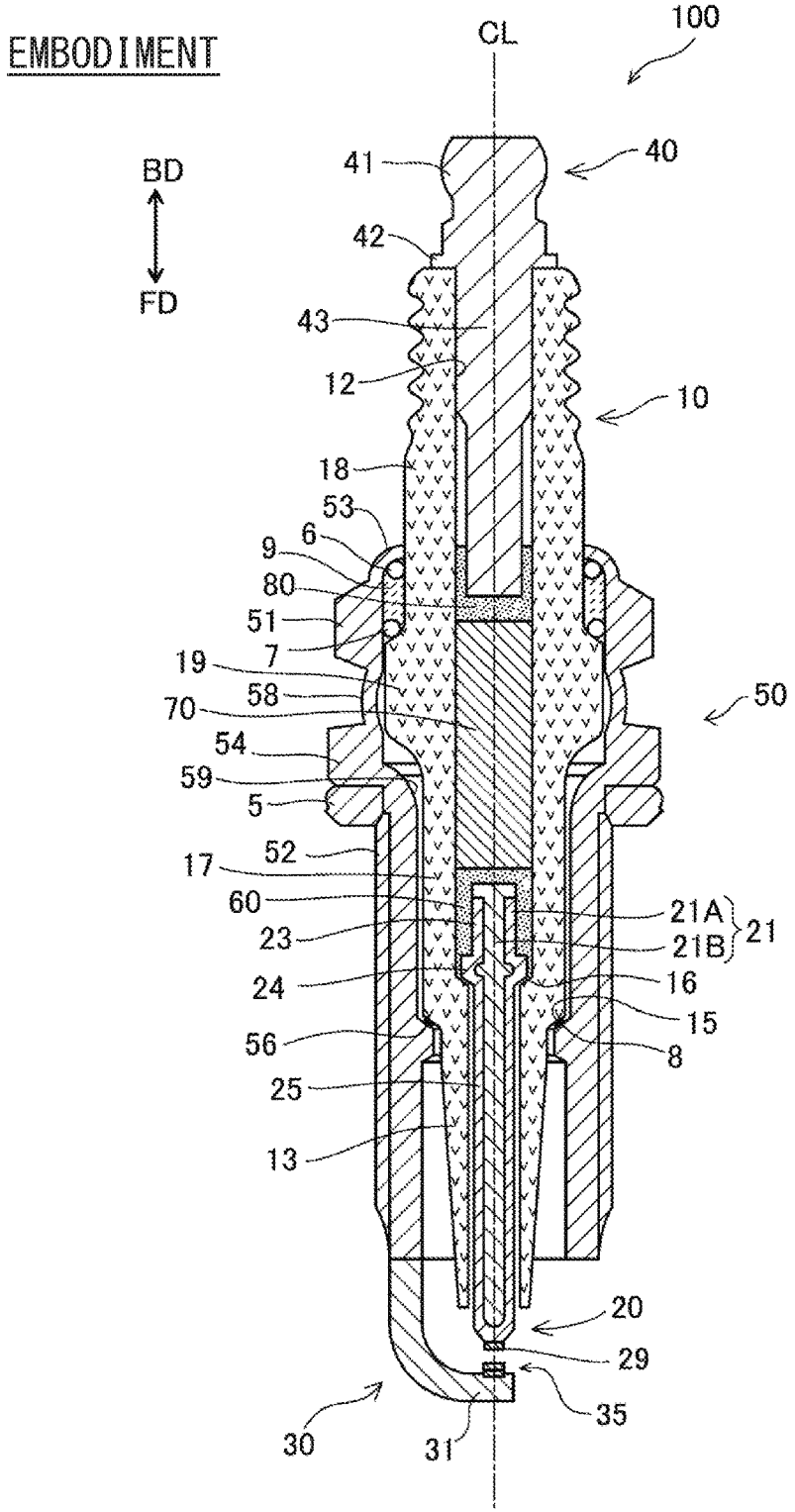
FIG. 1 is a cross-sectional view of a spark plug 100 of an embodiment of the present invention.

A-1. Structure of Spark Plug:

Hereinafter, a mode of the present invention will be described on the basis of an embodiment. FIG. 1 is a cross-sectional view of a spark plug 100 of the present embodiment. In FIG. 1, an alternate long and short dashed line indicates an axis CL of the spark plug 100. A direction (an upward-downward direction in FIG. 1) in parallel with the axis CL is also referred to as an axial direction. The radial direction of a circle about the axis CL on a plane perpendicular to the axis CL is also referred to merely as a "radial direction", and the circumferential direction of the circle is also referred to merely as a "circumferential direction". In FIG. 1, the downward direction is referred to as a front end direction FD, and the upward direction is also referred to as a rear end direction BD. The lower side in FIG. 1 is referred to as a front side of the spark plug 100, and the upper side in FIG. 1 is referred to as a rear side of the spark plug 100.

The spark plug 100 is mounted to an internal combustion engine and is used to ignite fuel gas within a combustion chamber of the internal combustion engine. The spark plug 100 is assumed to operate under a relatively high-temperature environment. Specifically, temperature in the vicinity of a discharge member (electrode tip) within the combustion chamber is assumed to be not less than 600° C. The spark plug 100 includes a ceramic insulator 10 as an insulator, a center electrode 20, a ground electrode 30, a metal terminal 40, and a metal shell 50.

The ceramic insulator 10 is formed by baking alumina or the like. The ceramic insulator 10 is a substantially cylindrical member having a through hole 12 (axial hole) that extends along the axial direction to penetrate through the ceramic insulator 10. The ceramic insulator 10 includes a flange portion 19, a rear trunk portion 18, a front trunk portion 17, a step portion 15, and a leg portion 13. The rear trunk portion 18 is located rearward of the flange portion 19 and has an outer diameter smaller than the flange portion 19. The front trunk portion 17 is located forward of the flange portion 19 and has an outer diameter smaller than the flange portion 19. The leg portion 13 is located forward of the front trunk portion 17 and has an outer diameter smaller than the front trunk portion 17. The leg portion 13 is exposed to a combustion chamber of an internal combustion engine (not shown) when the spark plug 100 is mounted to the internal combustion engine. The step portion 15 is formed between the leg portion 13 and the front trunk portion 17.

The metal shell 50 is formed from a conductive metal material (e.g., a low-carbon steel material) and is a cylindrical metal member for fixing the spark plug 100 to an engine head (not shown) of the internal combustion engine. The metal shell 50 has an insertion hole 59 penetrating along the axis CL. The metal shell 50 is disposed around the outer circumference of the ceramic insulator 10. That is, the ceramic insulator 10 is inserted and held in the insertion hole 59 of the metal shell 50. The front end of the ceramic insulator 10 projects forward of the front end of the metal shell 50. The rear end of the ceramic insulator 10 projects rearward of the rear end of the metal shell 50.

The metal shell 50 includes a hexagonal-prism-shaped tool engagement portion 51 with which a spark plug wrench engages, a mounting screw portion 52 for mounting the spark plug 100 to the internal combustion engine, a flange-like seat portion 54 formed between the tool engagement portion 51 and the mounting screw portion 52. The nominal diameter of the mounting screw portion 52 is, for example, any of M8 (8 mm), M10, M12, M14, and M18.

An annular gasket 5 which is formed by bending a metal plate is inserted between the mounting screw portion 52 and the seat portion 54 of the metal shell 50. The gasket 5 seals a gap between the spark plug 100 and the internal combustion engine (engine head) when the spark plug 100 is mounted to the internal combustion engine.

The metal shell 50 further includes: a thin crimp portion 53 provided at the rear side of the tool engagement portion 51; and a thin compressive deformation portion 58 provided between the seat portion 54 and the tool engagement portion 51. Annular ring members 6 and 7 are disposed in annular regions each formed between: the inner peripheral surface of a portion of the metal shell 50 from the tool engagement portion 51 to the crimp portion 53; and the outer peripheral surface of the rear trunk portion 18 of the ceramic insulator 10. Powder of a talc 9 is filled between the two ring members 6 and 7 in the regions. The rear end of the crimp portion 53 is bent radially inward and fixed to the outer peripheral surface of the ceramic insulator 10. The compressive deformation portion 58 of the metal shell 50 is compressively deformed by the crimp portion 53, which is fixed to the outer peripheral surface of the ceramic insulator 10, being pressed toward the front side during manufacturing. The ceramic insulator 10 is pressed within the metal shell 50 toward the front side via the ring members 6 and 7 and the talc 9 due to the compressive deformation of the compressive deformation portion 58. The step portion 15 (ceramic-insulator-side step portion) of the ceramic insulator 10 is pressed by a step portion 56 (metal-shell-side step portion), which is formed on the inner periphery of the mounting screw portion 52 of the metal shell 50, via an annular plate packing 8 formed from metal. As a result, the plate packing 8 prevents gas within the combustion chamber of the internal combustion engine from leaking to the outside through a gap between the metal shell 50 and the ceramic insulator 10.

The center electrode 20 includes: a rod-shaped center electrode body 21 extending in the axial direction; and a columnar center electrode tip 29 bonded to the front end of the center electrode body 21. The center electrode body 21 is disposed within the through hole 12 and at a front end side portion of the ceramic insulator 10. The center electrode body 21 is structured to include an electrode base material 21A, and a core portion 21B embedded in the electrode base material 21A. The electrode base material 21A is formed from, for example, nickel or an alloy containing nickel as a principal component. In the present embodiment, the electrode base material 21A is formed from INCONEL 601 ("INCONEL" is a registered trademark). The core portion 21B is formed from copper or an alloy containing copper as a principal component, the copper and the alloy having more excellent thermal conductivity than the alloy forming the electrode base material 21A. In the present embodiment, the core portion 21B is formed from copper.

In addition, the center electrode body 21 includes: a flange portion 24 provided at a predetermined position in the axial direction; a head portion 23 (electrode head portion) disposed rearward of the flange portion 24; and a leg portion 25 (electrode leg portion) disposed forward of the flange portion 24. The flange portion 24 is supported by a step portion 16 of the ceramic insulator 10. A front end portion of the leg portion 25, that is, the front end of the center electrode body 21 projects forward of the front end of the ceramic insulator 10. The center electrode tip 29 will be described later.

The ground electrode 30 includes: a ground electrode base material 31 bonded to the front end of the metal shell 50; and a clad electrode 35. The ground electrode 30 will be described later.

The metal terminal 40 is a rod-shaped member extending in the axial direction. The metal terminal 40 is formed from a conductive metal material (e.g., low-carbon steel), and a metal layer (e.g., Ni layer) for anticorrosion is formed on the surface of the metal terminal 40 by means of plating or the like. The metal terminal 40 includes a flange portion 42 (terminal flange portion) formed at a predetermined position in the axial direction, a cap mounting portion 41 located rearward of the flange portion 42, and a leg portion 43 (terminal leg portion) located forward of the flange portion 42. The cap mounting portion 41 of the metal terminal 40 is exposed on the side rearward of the ceramic insulator 10. The leg portion 43 of the metal terminal 40 is inserted into the through hole 12 of the ceramic insulator 10. A plug cap to which a high-voltage cable (not shown) is connected is mounted on the cap mounting portion 41, and a high voltage is applied to cause spark discharge.

In the through hole 12 of the ceramic insulator 10, a resistor 70 for reducing electric wave noise generated when spark occurs is disposed between the front end of the metal terminal 40 (the front end of the leg portion 43) and the rear end of the center electrode 20 (the rear end of the head portion 23). The resistor 70 is formed from, for example, a composition containing glass particles as a principal component, ceramic particles other than glass, and a conductive material. In the through hole 12, a gap between the resistor 70 and the center electrode 20 is filled with a conductive seal 60, and a gap between the resistor 70 and the metal terminal 40 is filled with a conductive seal 80. Each of the conductive seals 60 and 80 is formed from, for example, a composition containing particles of $B_2O_3$—$SiO_2$ glass or the like, and metal particles (Cu, Fe, etc.).

Figure 2A:
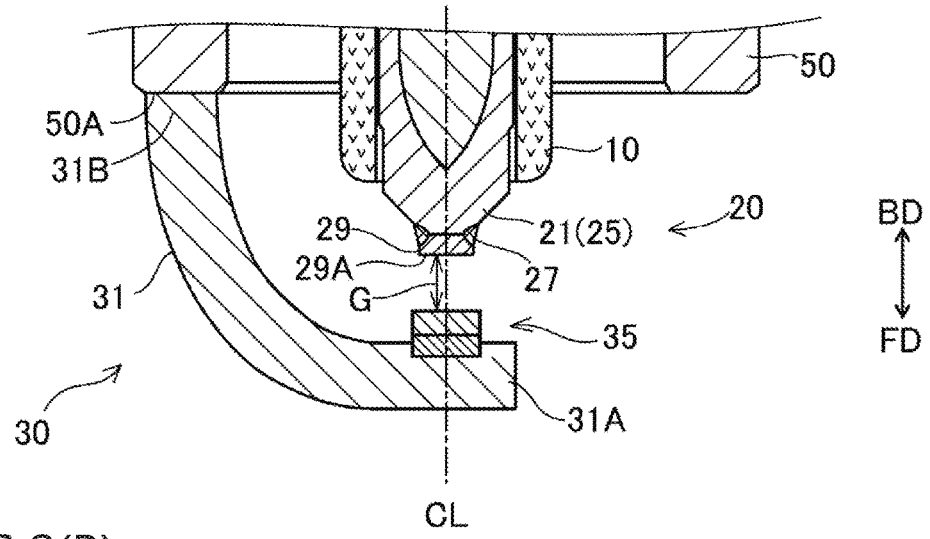
FIGS. 2(A) and 2(B) are diagrams illustrating a portion in the vicinity of the front end of the spark plug 100.
Figure 2B:
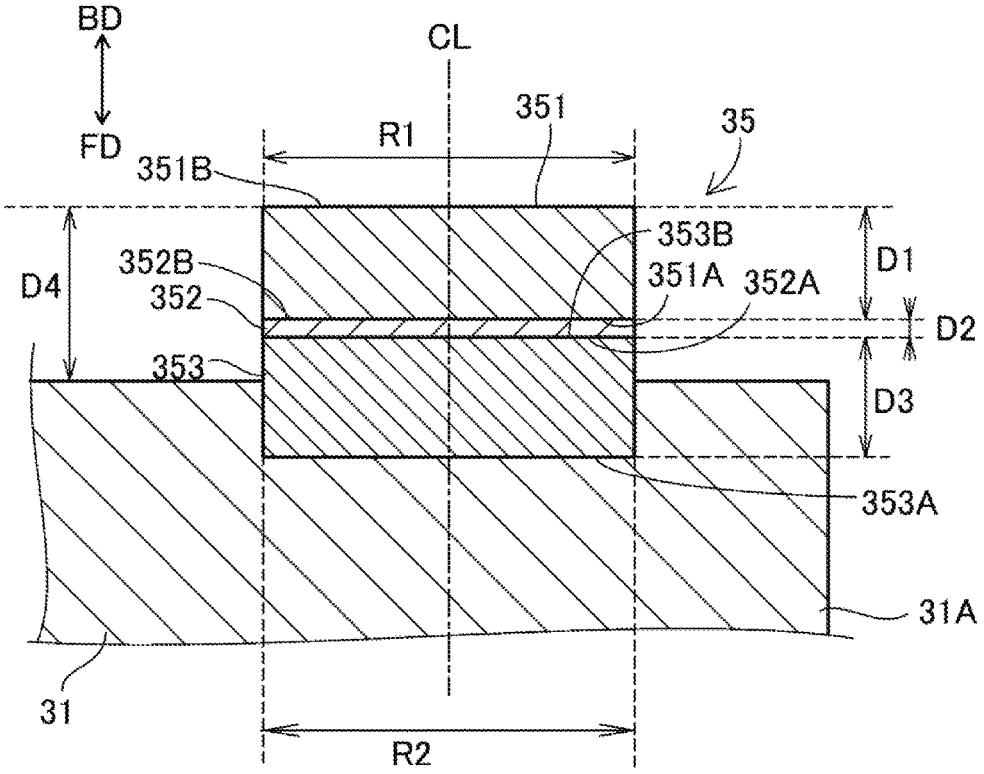

A-2. Structure of Front End Portion of Spark Plug 100:

The structure of the vicinity of the front end of the above-described spark plug 100 will be described further in detail. FIGS. 2(A) and 2(B) are diagrams illustrating a portion in the vicinity of the front end of the spark plug 100. FIG. 2(A) illustrates a specific cross section obtained by cutting a portion in the vicinity of the front end of the spark plug 100 at a specific plane including the axis CL. FIG. 2(B) is an enlarged view of the vicinity of the clad electrode 35 on the specific cross section in FIG. 2(A).

The center electrode tip 29 has a cylindrical shape, and is bonded to the front end of the center electrode body 21 (the front end of the leg portion 25) via, for example, a melt portion 27 formed by laser welding (FIG. 2(A)). The melt portion 27 is a portion that includes the component of the center electrode tip 29 and the component of the center electrode body 21. The center electrode tip 29 is formed of a material containing, as a principal component, a noble metal having a high melting point. As the material of the center electrode tip 29, for example, iridium (Ir), an alloy containing iridium as a principal component, platinum (Pt), or an alloy containing platinum as a principal component is used.

The ground electrode base material 31 is a bent bar-shaped body having a quadrangular cross section. A rear end portion 31B of the ground electrode base material 31 is bonded to a front end surface 50A of the metal shell 50. Accordingly, the metal shell 50 and the ground electrode base material 31 are electrically connected to each other. A front end portion 31A of the ground electrode base material 31 is a free end.

The ground electrode base material 31 is, for example, formed by using a nickel alloy, which will be described later in detail. In the ground electrode base material 31, a core material formed by using a metal having a thermal conductivity higher than a nickel alloy, for example, copper or an alloy containing copper may be embedded.

The clad electrode 35 includes a discharge member 351, an intermediate member 353, and a diffusion layer 352 formed between the discharge member 351 and the intermediate member 353.

The discharge member 351 has a cylindrical shape extending in the axial direction, and is formed by using an alloy containing platinum as a principal component, which will be described later in detail. The rear end surface of the discharge member 351 is a discharge surface 351B that forms a spark gap between the discharge surface 351B and a discharge surface 29A on the front side of the center electrode tip 29.

The intermediate member 353 has a cylindrical shape extending in the axial direction, and is formed by using an alloy containing platinum and nickel, which will be described later in detail. The intermediate member 353 is disposed between the discharge member 351 and the ground electrode base material 31. Specifically, the intermediate member 353 and the discharge member 351 are bonded to each other by diffusion bonding. That is, a rear end surface 353B of the intermediate member 353 is bonded, via the diffusion layer 352, to a front end surface 351A of the discharge member 351. A front end surface 353A of the intermediate member 353 is bonded to the rear side of the front end portion 31A of the ground electrode base material 31 by using resistance welding. A front side portion that includes the front end surface 353A of the intermediate member 353 is embedded in the front end portion 31A of the ground electrode base material 31.

Figure 3A:
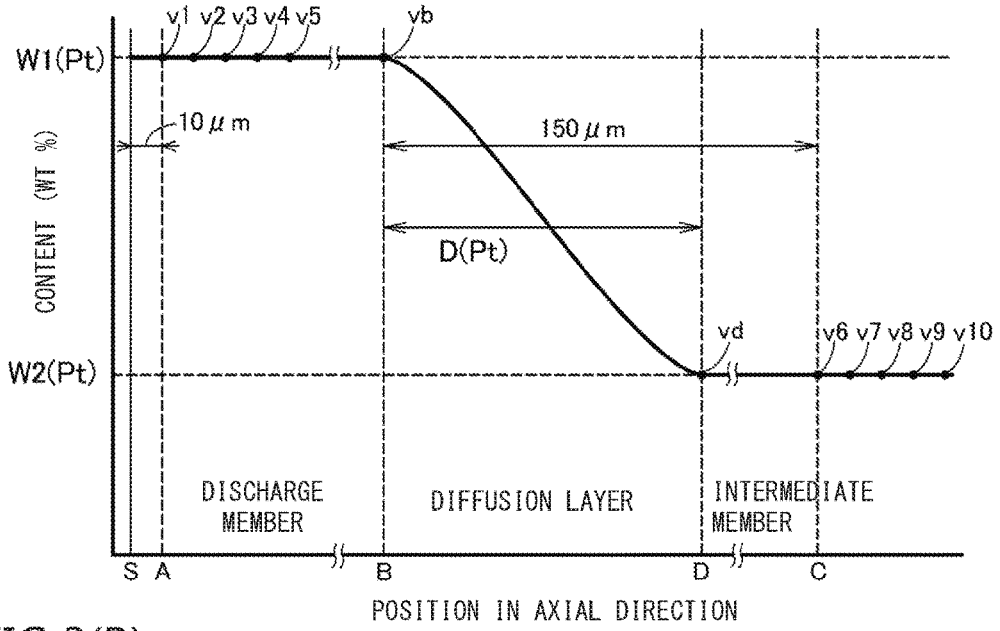
FIGS. 3(A) and 3(B) are explanatory views of a diffusion layer 352.
Figure 3B:
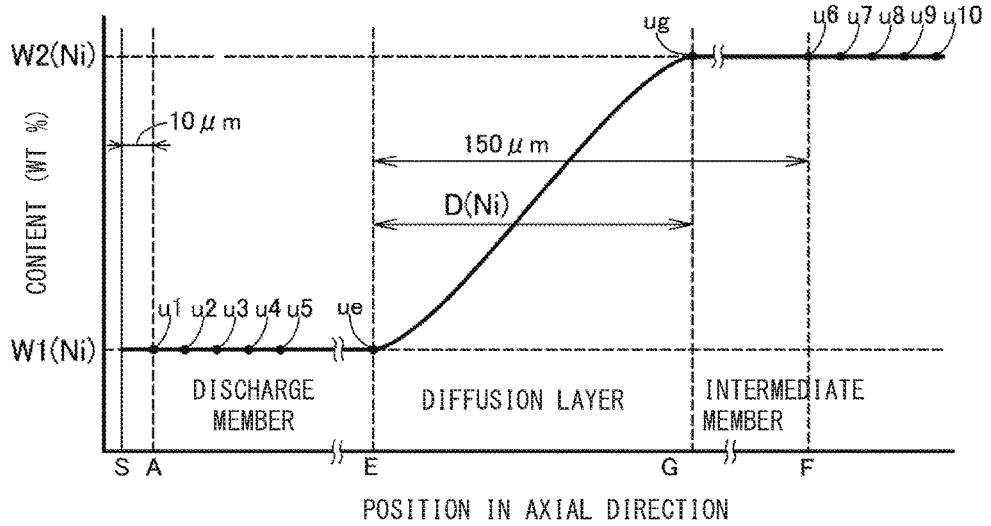

The diffusion layer 352 is formed between the discharge member 351 and the intermediate member 353. FIGS. 3(A) and 3(B) are explanatory diagrams of the diffusion layer 352. FIG. 3(A) indicates the content (unit is wt. %) of platinum at the position on the axis CL of the ground electrode 30. As indicated in FIG. 3(A), the content of platinum in the discharge member 351 is represented as W1(Pt), and the content of platinum in the intermediate member 353 is represented as W2(Pt). The content of platinum in the diffusion layer 352 continuously varies, from W1(Pt) to W2(Pt), going from the discharge member 351 side toward the intermediate member 353. FIG. 3(B) indicates the content (unit is wt. %) of nickel at the position on the axis CL of the ground electrode 30. The content of nickel in the discharge member 351 is represented as W1(Ni), and the content of nickel in the intermediate member 353 is represented as W2(Ni). The content of nickel in the diffusion layer 352 continuously varies, from W1(Ni) to W2(Ni), going from the discharge member 351 side toward the intermediate member 353. The same can be applied to another component (e.g., rhodium). That is, it can be said that the diffusion layer 352 is a layer in which the content of a specific component continuously varies, from the content of a specific component in the discharge member 351 to the content of a specific component in the intermediate member 353, going from the discharge member 351 toward the intermediate member 353. When each of the discharge member 351 and the intermediate member 353 includes an element other than platinum, rhodium, and nickel, an intermetallic compound may be formed in the diffusion layer 352. A combination of materials of the discharge member 351 and the intermediate member 353 is more preferably a combination of materials which does not form such an intermetallic compound.

As illustrated in FIG. 2(A), the length of a gap between the ground electrode 30 and the center electrode 20, that is, the shortest distance between the discharge surface 29A of the center electrode tip 29 and the discharge surface 351B of the discharge member 351 is represented as G. In addition, as illustrated in FIG. 2(B), the outer diameter of the discharge member 351 is represented as R1, and the outer diameter of the intermediate member 353 is represented as R2. In an example of FIG. 2(B), the outer diameter R1 of the discharge member 351 is equal to the outer diameter R2 of the intermediate member 353. In modification, the outer diameter R1 of the discharge member 351 may be smaller than the outer diameter R2 of the intermediate member 353. In addition, as illustrated in FIG. 2(B), a distance, along the axis CL direction, between the diffusion layer 352 and the discharge surface 351B of the discharge member 351 is represented as D1. In addition, the thickness of the diffusion layer 352, that is, the length of the diffusion layer 352 in the axial direction is represented as D2, and the thickness of the intermediate member 353 is represented as D3. In addition, the length (also called projecting length) from the discharge surface 351B of the discharge member 351 to the surface of the ground electrode base material 31 is represented as D4.

In the present embodiment, the thickness D2 of the diffusion layer 352 is not less than 0.002 mm and not more than 0.065 mm. As a result, it is possible to improve peeling resistance and wear resistance of the spark plug 100.

Details will be described. When the thickness D2 of the diffusion layer 352 is less than 0.002 mm, thermal stress between the discharge member 351 and the intermediate member 353 cannot be reduced by the diffusion layer 352. Therefore, the discharge member 351 and the intermediate member 353 are likely to be peeled off each other, and peeling resistance deteriorates. In addition, peeling between the discharge member 351 and the intermediate member 353 causes decrease in thermal conductivity between the discharge member 351 and the intermediate member 353. As a result, heat conduction decreases and the temperature of the discharge member 351 increases, and wear of the discharge member 351 increases, and wear resistance deteriorates.

When the thickness D2 of the diffusion layer 352 exceeds 0.065 mm, the thermal conductivity between the discharge member 351 and the intermediate member 353 is decreased since the diffusion layer 352 has thermal conductivity lower than the discharge member 351 and the intermediate member 353. Consequently, since the temperature of the discharge member 351 increases, the use of the spark plug 100 leads to progressing of interdiffusion between the discharge member 351 and the intermediate member 353, and therefore the thickness D2 of the diffusion layer 352 is further increased. As a result, the thermal conductivity between the discharge member 351 and the intermediate member 353 further decreases. As a result, heat conduction further decreases, the temperature of the discharge member 351 increases, and wear of the discharge member 351 increases. As a result, wear resistance deteriorates.

As described above, when the thickness D2 of the diffusion layer 352 is not less than 0.002 mm and not more than 0.065 mm, it is possible to suppress the above-described peeling due to thermal stress and increase in the thickness of the diffusion layer 352 due to the progressing of diffusion. Therefore, as described above, it is possible to improve peeling resistance and wear resistance of the spark plug 100.

A method for measuring a composition (e.g., contents of platinum and nickel) of the discharge member 351 and the intermediate member 353 and the thickness D2 of the diffusion layer 352 will be described with reference to FIGS. 3(A) and 3(B). These values can be obtained as follows, by performing point analysis by using FE-EPMA (Field Emission-Electron Probe Micro Analysis), specifically, by using WDS (Wavelength Dispersive X-ray Spectrometer) of JXA-8500F manufactured by JEOL Ltd.

An exemplary case where the discharge member 351 is Pt and the intermediate member 353 is Pt-10Ni will be described. First, the ground electrode 30 (the discharge member 351, the intermediate member 353, and the ground electrode base material 31) of the spark plug 100 is cut on a plane including the axis CL, and the ground electrode 30 on which the cross-sectional surface is polished is prepared as a sample for analysis. In the polished surface of the sample, point analysis is performed at five points starting from an originating point A (FIG. 3(A)) located forward (on the intermediate member 353 side) of a surface S (FIG. 3(A)) of the discharge member 351 on the axis CL, by 10 μm, along the axial direction, and the five points are located at intervals of 10 μm toward the front end side. As a result, the average of Pt contents v1 to v5 (FIG. 3(A)) measured at five points is determined as a platinum content W1 (Pt) of the discharge member 351.

Next, point analysis is performed at intervals of 0.5 μm from the point A along the axial direction toward the front side (toward the intermediate member 353), and a platinum content at each point is plotted. In the plotted graph, among points at which a platinum content Vb is less than W1(Pt) such that, at all the points forward of the point at which Vb=W1(Pt) is satisfied, the platinum content is not more than Vb, the rearmost point B (FIG. 3(A)) is specified. A position of the point B in the axial direction is regarded as the position of a boundary between the discharge member 351 and the diffusion layer 352 in the axial direction.

Next, a point C (FIG. 3(A)) forward of the point B by 150 μm along the axial direction is specified. From the originating point C, point analysis is performed at five points toward the front side at intervals of 10 μm. As a result, the average of Pt contents v6 to v10 (FIG. 3(A)) measured at the five points is determined as a platinum content W2 (Pt) of the intermediate member 353.

Next, point analysis is performed at intervals of 0.5 μm from the point C along the axial direction toward the rear side (toward the discharge member 351), and a platinum content at each point is plotted. In the plotted graph, among points at which a platinum content Vd is more than W2(Pt) such that, at all the points rearward of the point at which Vd=W2(Pt) is satisfied, the platinum content is not less than Vd, the foremost point D (FIG. 3(A)) is specified. A position of the point D in the axial direction is regarded as the position of a boundary between the intermediate member 353 and the diffusion layer 352 in the axial direction.

As described above, a distance between the specified points B and D in the axial direction is regarded as a thickness D(Pt)(FIG. 3(A)).

Such an analysis is performed for another component contained in any of the discharge member 351 and the intermediate member 353. In this example, the same analysis is performed for nickel. That is, an average of nickel contents u1 to u5 (FIG. 3(B)) measured at intervals of 10 μm at the five points starting from an originating point A (FIG. 3(B)) is determined as a nickel content W1(Ni) of the discharge member 351. Then, point analysis is performed at intervals of 0.5 μm from the point A along the axial direction toward the front side, and a nickel content at each point is plotted. In the plotted graph, among points at which the nickel content ue is more than W1(Ni) such that, at all the points forward of the point at which ue=W1(Ni) is satisfied, the nickel content is not less than ue, the rearmost point E (FIG. 3(B)) is specified. A position of the point E in the axial direction is regarded as the position of a boundary between the discharge member 351 and the diffusion layer 352 in the axial direction.

Next, a point F (FIG. 3(B)) forward of the point E by 150 μm along the axial direction is specified. From the originating point F, point analysis is performed at five points toward the front side at intervals of 10 μm. As a result, an average of nickel contents u6 to u10 (FIG. 3(B)) measured at the five points is determined as a nickel content W2 (Ni) of the intermediate member 353.

Next, point analysis is performed at intervals of 0.5 μm from the point F along the axial direction toward the rear side, and a nickel content at each point is plotted. In the plotted graph, among points at which the nickel content ug is less than W2(Ni) such that, at all the points rearward of the point at which ug=W2(Ni) is satisfied, nickel content is not more than ug, the foremost point G (FIG. 3(B)) is specified. A position of the point G in the axial direction is regarded as the position of a boundary between the intermediate member 353 and the diffusion layer 352 in the axial direction.

As described above, a distance between the specified points E and G in the axial direction is regarded as a thickness D(Ni) (FIG. 3(B)).

The maximum value of the thicknesses measured for respective components as described above is determined as the thickness D2 of the diffusion layer 352. In this example, the larger of values of the thickness D(Pt) measured for platinum and the thickness D(Ni) measured for nickel is determined as the thickness D2 of the diffusion layer 352.

Here, the point analysis for each of v1 to v10 and u1 to u10 as described above (point analysis at intervals of 10 μm) was performed at an accelerating voltage of 20 kV with a spot diameter of 10 μm, and point analysis for specifying the points B, D, E, and G (point analysis at intervals of 0.5 μm) was performed at an accelerating voltage of 20 kV with a spot diameter of 1 μm.

It is noted that, when the measured values vary depending on positions, the same measurement as described above is performed five times by displacing the measurement position (e.g., the position of the point A) in the radial direction, and the average of values obtained from the five times of measurement is determined as the final thickness D2 of the diffusion layer 352.

It is noted that the contents W1(Pt), W1(Ni), W2(Pt), and W2(Ni) measured at the points A, C, and F are values indicating the compositions of the discharge member 351 and the intermediate member 353. Depending on the surface state of the discharge member 351, and the thicknesses of the respective members 351, 352, and 353, in the points A, C, and F, there may be density gradient or these points may be located within the diffusion layer 352. Therefore, when the measured contents W1(Pt), W1(Ni), W2(Pt), and W2(Ni) do not appear to represent the compositions of the discharge member 351 and the intermediate member 353, the positions of the points A, C, and F are changed as appropriate and then measurement is performed.

In addition, in the above-described measurement, when precipitates or voids are included in the member 351, 352, and 353, if the measured value and an observation result of the composition indicate that there is a point at which precipitates or voids seem to affect the measured value, the average of values at two points that do not seem to be affected by precipitates or voids, are located forward and rearward of the point, and are closest to the point is used, instead of the value measured at the point.

It is noted that the thickness D2 of the diffusion layer 352 is preferably not less than 0.005 mm and not more than 0.065 mm. Thus, it is possible to more effectively suppress peeling between the discharge member 351 and the intermediate member 353 due to thermal stress. Therefore, it is possible to further improve peeling resistance and wear resistance of the spark plug 100.

Here, when a distance D1 between the diffusion layer 352 and the discharge surface 351B of the discharge member 351 is excessively short, rising of temperature of the discharge surface 351B due to discharge may cause the temperature in the vicinity of the diffusion layer 352 to be also high. As a result, the above-described interdiffusion is likely to progress when the spark plug 100 is used. Since a discharge voltage increases when a gap length G is excessively large, wear of the discharge member 351 increases. Since the above-described distance D1 becomes short early when the wear of the discharge member 351 increases, the use of the spark plug 100 causes the progressing of the above described interdiffusion. Therefore, it is preferable that as the gap length G is larger, the distance D1 is larger. Specifically, the gap length G and the distance D1 between the diffusion layer 352 and the discharge surface 351B of the discharge member 351 preferably satisfy (D1/G)≥0.1. That is, the distance D1 is preferably not less than 10% of the gap length G. Thus, since it is possible to suppress the progressing of the above described interdiffusion, it is possible to further improve peeling resistance and wear resistance of the spark plug 100. However, when the distance D1 is excessively small, even if (D1/G) is controlled so as to satisfy (D1/G)≥0.1, it is difficult to obtain an effect of suppressing the progressing of interdiffusion. Therefore, it is preferable to satisfy D1≥0.1.

It is noted that, since the discharge member 351 contains relatively expensive platinum as a principal component, it is not preferable that the distance D1 is unnecessarily large. For example, the distance D1 is preferably less than 0.4 mm.

The ground electrode 30 is, for example, manufactured as follows. The discharge member 351 and the intermediate member 353 are bonded to each other by diffusion bonding. Specifically, for example, a manufacturer performs preliminary bonding of the discharge member 351 and the intermediate member 353 by resistance welding. The manufacturer performs heat treatment, under a predetermined condition, for the discharge member 351 and the intermediate member 353 that have been preliminarily bonded to each other, to perform diffusion bonding of the discharge member 351 and the intermediate member 353. As a result, the diffusion layer 352 is formed between the discharge member 351 and the diffusion layer 352. The heat treatment is a treatment of holding, for example, in a furnace in vacuum or inert gas atmosphere, the discharge member 351 and the intermediate member 353 that have been preliminarily bonded to each other at a temperature of 700° C. to 1300° C. for 0 to 100 hours. The reason for including 0 hour is not that no heat treatment is performed, but that, when the temperature has risen to a target temperature, the temperature may be decreased without maintaining the temperature. If time and temperature are properly controlled, heat treatment may be performed in the air. By adjusting the conditions of heat treatment, it is possible to control the thickness D2 of the diffusion layer 352. For example, the higher the temperature to be maintained is, the larger the thickness D2 of the diffusion layer 352 can be. The longer the holding time is, the larger the thickness D2 of the diffusion layer 352 can be. In addition, the discharge member 351 and the intermediate member 353 bonded to each other by diffusion bonding may be formed by: processing melted materials obtained by blending and melting the components of the discharge member 351 and the intermediate member 353 into the respective plate materials by rolling or the like; stacking the two plate materials and then further performing rolling of the two plate materials at room temperature or hot rolling thereof; and punching the two plate materials after the rolling into predetermined shapes. Also in this case, in order to form the desired diffusion layer 352 by progressing of solid phase diffusion, heat treatment may be performed for the two plate materials after the rolling or punching as appropriate.

The manufacturer bonds the clad electrode 35, that is, the discharge member 351 and the intermediate member 353 that have been bonded to each other by diffusion bonding, to the ground electrode base material 31 by resistance welding. It is possible to control the distance of the intermediate member 353 embedded in the ground electrode base material 31, by controlling applied pressure, current, and energizing time during resistance welding.

A-2. Material of Ground Electrode 30

Next, a material that forms the ground electrode 30 will be described. The material of the ground electrode base material 31 of the ground electrode 30 is a metallic material that contains not less than 50 wt. % of nickel (Ni). Specifically, INCONEL 601 (Ni content of about 60 wt. %), INCONEL 600 (Ni content of about 75 wt. %), a Ni alloy (Ni content of about not less than 90 wt. %) having higher Ni content, or the like is used as the material of the ground electrode base material 31. Here, the ground electrode base material 31 represents a member that includes at least a part that includes a surface to which the clad electrode 35 is bonded and that is formed from the same material as that of the part that includes the surface to which the clad electrode 35 is bonded. For example, here, when the ground electrode base material 31 has a multilayer structure including a core material such as copper, the core material is not included in the ground electrode base material 31.

The material of the discharge member 351 of the ground electrode 30 is a material that satisfies the following (1) to (3).

(1) Not less than 45 wt. % of platinum (Pt) and at least one of nickel and rhodium (Rh) are contained.

(2) The content of platinum is highest.

(3) The total content of platinum, rhodium, and nickel is not less than 92 wt. %.

When the above-described (1) to (3) are satisfied, it is possible to improve peeling resistance and wear resistance of the spark plug 100.

Details will be described. When the content of platinum is highest (the above-described (2)), for example, it is possible to improve wear resistance at high temperature as compared to a case where iridium that is poor in oxidation resistance because of forming a volatile oxide at a high temperature is a principal component. Furthermore, by adding nickel or rhodium (the above-described (1)), it is possible to suppress grain growth of platinum and generation of intercrystalline cracking, whereby it is possible to improve peeling resistance. Since decrease in heat conduction occurs when the discharge member 351 is peeled, this results in deterioration of wear resistance. Although grain growth can be suppressed also when iridium is added, iridium is easily oxidized and volatilized. Therefore, wear occurs in iridium during use of the spark plug 100, and the effect of suppressing grain growth is lost as time elapses. Furthermore, since nickel and rhodium are superior to iridium also in oxidation resistance, the added amount is less likely to decrease during use of the spark plug 100. Accordingly, since it is possible to suppress grain growth and intercrystalline cracking for a long time, it is possible to improve peeling resistance and wear resistance.

Furthermore, in order to improve peeling resistance and wear resistance, by use of the spark plug 100, embrittlement of the diffusion layer 352 that occurs due to progressing of interdiffusion between the discharge member 351 and the intermediate member 353 and decrease in thermal conductivity of the diffusion layer 352 need to be reduced. This is because the embrittlement of the diffusion layer 352 causes peeling of the discharge member 351. In addition, decrease in thermal conductivity of the diffusion layer 352 causes decrease in heat conduction, resulting in increase in wear of the discharge member 351.

The embrittlement of the diffusion layer 352 and the decrease in thermal conductivity of the diffusion layer 352 are caused by increased kinds of elements having different characteristics being mixed in the diffusion layer 352. Therefore, in order to suppress the embrittlement of the diffusion layer 352 and the decrease in thermal conductivity of the diffusion layer 352, elements to be added to the discharge member 351 are preferably similar to nickel and platinum each of which is a principal component of the intermediate member 353 described later, or elements whose properties are similar to those of platinum and nickel. Nickel and rhodium that are elements added to the discharge member 351 are similar to platinum in properties such as crystal structure. Therefore, even if interdiffusion between the discharge member 351 and the intermediate member 353 progresses, it is possible to suppress embrittlement of the diffusion layer 352 and decrease in thermal conductivity of the diffusion layer 352.

Furthermore, when the total content of platinum, rhodium, and nickel is not less than 92 wt. % (the above-described (3)), the proportions of elements superior in oxidation resistance is increased and it is possible to improve wear resistance. In addition, by suppressing the proportions of other elements, it is possible to suppress the mixture of other elements in the diffusion layer 352 due to interdiffusion as described above. Therefore, it is possible to suppress embrittlement of the diffusion layer 352 and decrease in thermal conductivity of the diffusion layer 352 as described above.

Furthermore, the total content of platinum, rhodium, and nickel in the discharge member 351 is more preferably not less than 96 wt. %. Thus, by further decreasing the components other than platinum, rhodium, and nickel in the discharge member 351, it is possible to further suppress embrittlement of the diffusion layer 352 and decrease in thermal conductivity of the diffusion layer 352 as described above.

Furthermore, it is particularly preferable that, in the discharge member 351, the total content of platinum, rhodium, and nickel is not less than 96 wt. % and the total content of platinum and rhodium is not less than 88 wt. %. Thus, by further decreasing the components other than platinum, rhodium, and nickel in the discharge member 351, it is possible to further suppress embrittlement of the diffusion layer 352 and decrease in thermal conductivity of the diffusion layer 352 as described above, and by decreasing the components other than platinum superior in wear resistance and rhodium which allows suppression of the grain growth of the platinum, it is possible to further improve wear resistance.

The material of the intermediate member 353 of the ground electrode 30 is a material that satisfies the following (4) to (6).

(4) Platinum and nickel are contained, and the content of one of platinum and nickel is not less than 50 wt. %.

(5) The nickel content is higher than the nickel content in the discharge member 351.

(6) The total content of platinum, rhodium, and nickel is not less than 85 wt. %.

Details will be described. Platinum and nickel are contained and the content of one of platinum and nickel is not less than 50 wt. % (the above-described (4)), and the total content of platinum, rhodium, and nickel is not less than 85 wt. % (the above-described (6)). Therefore, the principal component of the intermediate member 353 can be platinum, nickel, or rhodium of the same component contained in the discharge member 351, or can be a component having properties similar thereto. As a result, it is possible to suppress the mixture of another component in the diffusion layer 352 due to the above-described interdiffusion. Therefore, it is possible to suppress embrittlement of the diffusion layer 352 and decrease in thermal conductivity of the diffusion layer 352 as described above.

Furthermore, the intermediate member 353 contains platinum and nickel (the above-described (4)) and the content of nickel in the intermediate member 353 is higher than the content of nickel in the discharge member 351 (the above-described (5)). Therefore, a thermal expansion coefficient of the intermediate member 353 can be set so as to be between a thermal expansion coefficient of the discharge member 351 and a thermal expansion coefficient of the ground electrode base material 31. As a result, since it is possible to decrease thermal stress generated between the intermediate member 353 and the discharge member 351, and between the intermediate member 353 and the ground electrode base material 31, it is possible to improve peeling resistance of the discharge member 351.

As described above, by satisfying the above-described (4) to (6), it is possible to improve peeling resistance and wear resistance of the spark plug 100.

Furthermore, in the intermediate member 353, the total content of platinum, rhodium, and nickel is more preferably not less than 96 wt. %. Thus, by further decreasing the components other than platinum, rhodium, and nickel in the intermediate member 353, it is possible to further suppress embrittlement of the diffusion layer 352 and decrease in thermal conductivity of the diffusion layer 352 as described above.

Furthermore, in the intermediate member 353, it is more preferable that the nickel content is higher than the nickel content in the discharge member 351 by not less than 2.5 wt. %. Thus, the thermal expansion coefficient of the intermediate member 353 can be a more appropriate value between the thermal expansion coefficient of the discharge member and the thermal expansion coefficient of the electrode base material. As a result, especially, it is possible to more effectively decrease thermal stress generated in a portion, between the ground electrode base material 31 and the intermediate member 353, at which the diffusion layer 352 is not formed. Therefore, it is possible to further improve peeling resistance of the discharge member 351.

B. Evaluation Test

By using samples of spark plugs, evaluation test was performed to evaluate wear resistance and peeling resistance. In the evaluation test, as shown in Tables 1 to 4, 66 types of samples 1 to 66 were produced. In each sample, components other than the ground electrode 30 are the same as those of the spark plug 100 described above and are common thereamong.

In Table 1, regarding samples 1 to 50, for each sample, a material of the discharge member 351, the distance D1 from the diffusion layer 352 to the discharge surface 351B of the discharge member 351, the gap length G, a value of (D1/G), the thickness D2 of the diffusion layer 352 are indicated. It is noted that, in Table 1, a calculated value of (D1/G), the total content (Pt+Rh+Ni) of platinum, rhodium, and nickel in the discharge member 351, and the total content (Pt+Rh) of platinum and rhodium in the discharge member 351 are also indicated. In Table 2, regarding samples 1 to 50, a material of the intermediate member 353, and evaluation results of wear resistance and peeling resistance are indicated. In addition, in Table 2, the total content (Pt+Rh+Ni) of platinum, rhodium, and nickel in the intermediate member 353, and a difference ΔW(Ni) obtained by subtracting the nickel content in the discharge member 351 from the nickel content in the intermediate member 353 are also indicated. In Tables 3 and 4, regarding samples 51 to 66, the same items as those in Tables 1 and 2 are indicated.

The clad electrode 35 of each of the 66 types of samples was manufactured by diffusion bonding of the cylindrical intermediate member 353 having an outer diameter of 1.6 mm and a thickness of 0.4 mm to the cylindrical discharge member 351 having an outer diameter of 1.6 mm. The clad electrode 35 of each of the manufactured samples was welded to the ground electrode base material 31 by resistance welding, such that the projecting length D4 (FIGS. 2(A) and 2(B)) were less than 0.4 mm. It is noted that for all samples, INCONEL 601 was used as the material of the ground electrode base material 31.

Then, as indicated in Tables 1 to 4, the material of each of the discharge member 351 and the intermediate member 353 was changed for each sample. Furthermore, the 66 types of samples 1 to 66 as indicated in Tables 1 to 4 were manufactured by changing a length of the discharge member 351 in the axial direction, a condition of heat treatment in diffusion bonding, and the gap length G.

TABLE 1

| | Discharge member | | | | | | | | | | | | |
|---|---|---|---|---|---|---|---|---|---|---|---|---|---|
| No. | Pt | Rh | Ni | Ir | Re | Pd | Au | Pt + Rh + Ni | Pt + Rh | D1 | G | D1/G | D2 |
| 1 | 100 | | | | | | | 100 | 100 | 0.1 | 1 | 0.10 | 0.007 |
| 2 | 80 | | | 20 | | | | 80 | 80 | 0.1 | 1 | 0.10 | 0.007 |
| 3 | 80 | 20 | | | | | | 100 | 100 | 0.27 | 1 | 0.27 | 0.027 |
| 4 | 80 | | | 20 | | | | 80 | 80 | 0.1 | 1 | 0.10 | 0.012 |
| 5 | 80 | | | 20 | | | | 80 | 80 | 0.1 | 1 | 0.10 | 0.007 |
| 6 | 80 | 20 | | | | | | 100 | 100 | 0.1 | 1 | 0.10 | 0.007 |
| 7 | 80 | 20 | | | | | | 100 | 100 | 0.25 | 1.3 | 0.19 | 0.001 |
| 8 | 80 | 20 | | | | | | 100 | 100 | 0.25 | 1.3 | 0.19 | 0.075 |
| 9 | 85 | 5 | | | 10 | | | 90 | 90 | 0.1 | 1 | 0.10 | 0.007 |
| 10 | 85 | 5 | | | | 10 | | 90 | 90 | 0.1 | 1 | 0.10 | 0.001 |
| 11 | 88.5 | | 1.5 | | 10 | | | 90 | 88.5 | 0.13 | 1.3 | 0.10 | 0.007 |
| 12 | 88.5 | | 1.5 | | | | 10 | 90 | 88.5 | 0.1 | 1 | 0.10 | 0.007 |
| 13 | 90 | | 10 | | | | | 100 | 90 | 0.12 | 1.3 | 0.09 | 0.047 |
| 14 | 95 | 5 | | | | | | 100 | 100 | 0.13 | 1.4 | 0.09 | 0.007 |
| 15 | 95 | 5 | | | | | | 100 | 100 | 0.09 | 0.4 | 0.23 | 0.065 |
| 16 | 95 | 5 | | | | | | 100 | 100 | 0.1 | 1 | 0.10 | 0.002 |
| 17 | 95 | 5 | | | | | | 100 | 100 | 0.2 | 1 | 0.20 | 0.002 |
| 18 | 95 | 5 | | | | | | 100 | 100 | 0.3 | 1 | 0.30 | 0.002 |
| 19 | 87 | 5 | | | | 8 | | 92 | 92 | 0.2 | 1 | 0.20 | 0.002 |
| 20 | 91 | 5 | | | | 4 | | 96 | 96 | 0.2 | 1 | 0.20 | 0.002 |
| 21 | 95 | 5 | | | | | | 100 | 100 | 0.13 | 1.3 | 0.10 | 0.002 |
| 22 | 95 | 5 | | | | | | 100 | 100 | 0.2 | 1 | 0.20 | 0.002 |
| 23 | 95 | 5 | | | | | | 100 | 100 | 0.2 | 1 | 0.20 | 0.002 |
| 24 | 95 | 5 | | | | | | 100 | 100 | 0.2 | 0.4 | 0.50 | 0.065 |
| 25 | 95 | 5 | | | | | | 100 | 100 | 0.2 | 0.8 | 0.25 | 0.065 |
| 26 | 95 | 5 | | | | | | 100 | 100 | 0.2 | 1 | 0.20 | 0.008 |
| 27 | 95 | 5 | | | | | | 100 | 100 | 0.15 | 1.1 | 0.14 | 0.002 |
| 28 | 95 | 5 | | | | | | 100 | 100 | 0.15 | 1.1 | 0.14 | 0.065 |
| 29 | 90 | 10 | | | | | | 100 | 100 | 0.15 | 1.1 | 0.14 | 0.002 |
| 30 | 90 | 10 | | | | | | 100 | 100 | 0.15 | 1.1 | 0.14 | 0.005 |
| 31 | 90 | 10 | | | | | | 100 | 100 | 0.15 | 1.1 | 0.14 | 0.005 |
| 32 | 90 | 10 | | | | | | 100 | 100 | 0.13 | 1.3 | 0.10 | 0.007 |
| 33 | 80 | 20 | | | | | | 100 | 100 | 0.15 | 1.1 | 0.14 | 0.005 |
| 34 | 80 | 20 | | | | | | 100 | 100 | 0.15 | 1.1 | 0.14 | 0.005 |
| 35 | 80 | 20 | | | | | | 100 | 100 | 0.15 | 1.1 | 0.14 | 0.007 |
| 36 | 80 | 20 | | | | | | 100 | 100 | 0.2 | 0.4 | 0.50 | 0.012 |
| 37 | 80 | 20 | | | | | | 100 | 100 | 0.25 | 1.3 | 0.19 | 0.002 |
| 38 | 80 | 20 | | | | | | 100 | 100 | 0.25 | 1.3 | 0.19 | 0.005 |
| 39 | 80 | 20 | | | | | | 100 | 100 | 0.25 | 1.3 | 0.19 | 0.065 |
| 40 | 60 | 40 | | | | | | 100 | 100 | 0.15 | 1.1 | 0.14 | 0.002 |
| 41 | 48 | 40 | 12 | | | | | 100 | 88 | 0.15 | 1.1 | 0.14 | 0.009 |
| 42 | 45 | 40 | 15 | | | | | 100 | 85 | 0.15 | 1.1 | 0.14 | 0.005 |
| 43 | 50 | 45 | 5 | | | | | 100 | 95 | 0.15 | 1.1 | 0.14 | 0.012 |

TABLE 1-continued

| | Discharge member | | | | | | | | | | | | |
|---|---|---|---|---|---|---|---|---|---|---|---|---|---|
| No. | Pt | Rh | Ni | Ir | Re | Pd | Au | Pt + Rh + Ni | Pt + Rh | D1 | G | D1/G | D2 |
| 44 | 98.5 | | 1.5 | | | | | 100 | 98.5 | 0.12 | 1.3 | 0.09 | 0.002 |
| 45 | 98.5 | | 1.5 | | | | | 100 | 98.5 | 0.12 | 1.3 | 0.09 | 0.002 |
| 46 | 98.5 | | 1.5 | | | | | 100 | 98.5 | 0.12 | 1.3 | 0.09 | 0.002 |
| 47 | 98.5 | | 1.5 | | | | | 100 | 98.5 | 0.15 | 1 | 0.15 | 0.002 |
| 48 | 94.5 | | 1.5 | | | | 4 | 96 | 94.5 | 0.11 | 1.3 | 0.08 | 0.007 |
| 49 | 90.5 | | 1.5 | | | | 8 | 92 | 90.5 | 0.1 | 1.2 | 0.08 | 0.004 |
| 50 | 90.5 | | 1.5 | | | | 8 | 92 | 90.5 | 0.1 | 1.2 | 0.08 | 0.007 |

TABLE 2

| | Intermediate member | | | | | | | | | | Evaluation results | | |
|---|---|---|---|---|---|---|---|---|---|---|---|---|---|
| No. | Pt | Rh | Ni | ΔW (Ni) | Ir | Pd | Au | Cr | Co | Pt + Rh + Ni | Wear resistance | Peeling resistance 1 | Peeling resistance 2 |
| 1 | 80 | | 20 | 20 | | | | | | 100 | C | C | A |
| 2 | 80 | | | 0 | | | 20 | | | 80 | C | C | C |
| 3 | 0 | | 99 | 99 | 1 | | | | | 99 | C | C | A |
| 4 | 80 | | 20 | 20 | | | | | | 100 | C | C | A |
| 5 | 40 | | | 0 | | 60 | | | | 40 | C | C | C |
| 6 | 98.5 | | | 0 | | | | | 1.5 | 98.5 | A | C | C |
| 7 | 80 | | 20 | 20 | | | | | | 100 | C | C | A |
| 8 | 80 | | 20 | 20 | | | | | | 100 | C | C | A |
| 9 | 97.5 | | 2.5 | 2.5 | | | | | | 100 | C | C | A |
| 10 | 98 | | 2 | 2 | | | | | | 100 | C | C | A |
| 11 | 96 | | 4 | 2.5 | | | | | | 100 | C | C | A |
| 12 | 92 | | 4 | 2.5 | 4 | | | | | 96 | C | C | A |
| 13 | 66 | 5 | 12 | 2 | | | | | 17 | 83 | C | C | B |
| 14 | 97.5 | | 2.5 | 2.5 | | | | | | 100 | A | SS | A |
| 15 | 97.5 | | 2.5 | 2.5 | | | | | | 100 | A | SS | A |
| 16 | 98.5 | | 1.5 | 1.5 | | | | | | 100 | A | SS | B |
| 17 | 98.5 | | 1.5 | 1.5 | | | | | | 100 | A | SS | B |
| 18 | 98.5 | | 1.5 | 1.5 | | | | | | 100 | A | SS | B |
| 19 | 98.5 | | 1.5 | 1.5 | | | | | | 100 | B | S | B |
| 20 | 98.5 | | 1.5 | 1.5 | | | | | | 100 | A | SS | B |
| 21 | 97.5 | | 2.5 | 2.5 | | | | | | 100 | A | SS | A |
| 22 | 97.5 | | 2.5 | 2.5 | | | | | | 100 | A | SS | A |
| 23 | 95 | | 5 | 5 | | | | | | 100 | A | SS | A |
| 24 | 95 | | 5 | 5 | | | | | | 100 | A | SSS | A |
| 25 | 95 | | 5 | 5 | | | | | | 100 | A | SSS | A |
| 26 | 91 | | 5 | 5 | | 4 | | | | 96 | A | SSS | A |
| 27 | 80 | | 20 | 20 | | | | | | 100 | A | SS | A |
| 28 | 80 | | 20 | 20 | | | | | | 100 | A | SSS | A |
| 29 | 95 | | 5 | 5 | | | | | | 100 | A | SS | A |
| 30 | 91 | | 5 | 5 | 2 | 2 | | | | 96 | A | SSS | A |
| 31 | 90 | | 10 | 10 | | | | | | 100 | A | SSS | A |
| 32 | 80 | | 10 | 10 | 5 | 5 | | | | 90 | A | SS | A |
| 33 | 95 | | 5 | 5 | | | | | | 100 | A | SSS | A |
| 34 | 90 | | 10 | 10 | | | | | | 100 | A | SSS | A |
| 35 | 80 | | 20 | 20 | | | | | | 100 | A | SSS | A |
| 36 | 80 | | 20 | 20 | | | | | | 100 | A | SSS | A |
| 37 | 80 | | 20 | 20 | | | | | | 100 | A | SS | A |
| 38 | 80 | | 20 | 20 | | | | | | 100 | A | SSS | A |
| 39 | 80 | | 20 | 20 | | | | | | 100 | A | SSS | A |
| 40 | 80 | | 20 | 20 | | | | | | 100 | A | SS | A |
| 41 | 80 | | 20 | 8 | | | | | | 100 | A | SSS | A |
| 42 | 80 | | 20 | 5 | | | | | | 100 | B | SSS | A |
| 43 | 80 | | 20 | 15 | | | | | | 100 | A | SSS | A |
| 44 | 92 | | 3 | 1.5 | | | | 5 | | 95 | A | A | B |
| 45 | 91 | | 4 | 2.5 | | | | 5 | | 95 | A | A | A |
| 46 | 96 | | 4 | 2.5 | | | | | | 100 | A | S | A |
| 47 | 93.5 | 3 | 3.5 | 2 | | | | | | 100 | A | SS | B |
| 48 | 91 | | 4 | 2.5 | 5 | | | | | 95 | A | S | A |
| 49 | 91 | | 4 | 2.5 | 5 | | | | | 95 | B | B | A |
| 50 | 91 | | 4 | 2.5 | 5 | | | | | 95 | B | A | A |

TABLE 3

| | Discharge member | | | | | | | | | | | | |
|---|---|---|---|---|---|---|---|---|---|---|---|---|---|
| No. | Pt | Rh | Ni | Ir | Re | Pd | Au | Pt + Rh + Ni | Pt +Rh | D1 | G | D1/G | D2 |
| 51 | 90.5 | | 1.5 | | | | 8 | 92 | 90.5 | 0.1 | 1 | 0.10 | 0.007 |
| 52 | 98.5 | | 1.5 | | | | | 100 | 98.5 | 0.2 | 1 | 0.20 | 0.002 |
| 53 | 98.5 | | 1.5 | | | | | 100 | 98.5 | 0.38 | 1 | 0.38 | 0.002 |
| 54 | 98.5 | | 1.5 | | | | | 100 | 98.5 | 0.2 | 1 | 0.20 | 0.002 |
| 55 | 98.5 | | 1.5 | | | | | 100 | 98.5 | 0.2 | 1.1 | 0.18 | 0.005 |
| 56 | 90.5 | | 1.5 | | 8 | | | 92 | 90.5 | 0.2 | 1.1 | 0.18 | 0.012 |
| 57 | 90.5 | | 1.5 | | | | 8 | 92 | 90.5 | 0.13 | 1.3 | 0.10 | 0.007 |
| 58 | 95 | | 5 | | | | | 100 | 95 | 0.2 | 1.1 | 0.18 | 0.007 |
| 59 | 95 | | 5 | | | | | 100 | 95 | 0.2 | 1.1 | 0.18 | 0.007 |
| 60 | 90 | | 10 | | | | | 100 | 90 | 0.12 | 1.3 | 0.09 | 0.047 |
| 61 | 90 | | 10 | | | | | 100 | 90 | 0.2 | 1.1 | 0.18 | 0.022 |
| 62 | 90 | | 10 | | | | | 100 | 90 | 0.2 | 1.1 | 0.18 | 0.022 |
| 63 | 90 | | 10 | | | | | 100 | 90 | 0.2 | 1.1 | 0.18 | 0.017 |
| 64 | 90 | | 10 | | | | | 100 | 90 | 0.2 | 1.1 | 0.18 | 0.022 |
| 65 | 80 | | 20 | | | | | 100 | 80 | 0.2 | 1.1 | 0.18 | 0.017 |
| 66 | 75 | | 25 | | | | | 100 | 75 | 0.2 | 1.1 | 0.18 | 0.012 |

TABLE 4

| | Intermediate member | | | | | | | | | | Evaluation results | | |
|---|---|---|---|---|---|---|---|---|---|---|---|---|---|
| No. | Pt | Rh | Ni | Ir | ΔW (Ni) | Pd | Au | Cr | Co | Pt + Rh + Ni | Wear resistance | Peeling resistance 1 | Peeling resistance 2 |
| 51 | 91 | | 4 | 2.5 | 5 | | | | | 95 | B | S | A |
| 52 | 96 | | 4 | 2.5 | | | | | | 100 | A | SS | A |
| 53 | 96 | | 4 | 2.5 | | | | | | 100 | A | SS | A |
| 54 | 96 | | 4 | 2.5 | | | | | | 100 | A | SS | A |
| 55 | 93 | 3 | 4 | 2.5 | | | | | | 100 | A | SSS | A |
| 56 | 93 | 3 | 4 | 2.5 | | | | | | 100 | B | SS | A |
| 57 | 92 | | 4 | 2.5 | 4 | | | | | 96 | B | SS | A |
| 58 | 89 | | 7 | 2 | | | | | 4 | 96 | A | SSS | B |
| 59 | 90 | | 10 | 5 | | | | | | 100 | A | SSS | A |
| 60 | 68 | 5 | 12 | 2 | | | | | 15 | 85 | A | S | B |
| 61 | 85 | | 15 | 5 | | | | | | 100 | A | SSS | A |
| 62 | 60 | | 40 | 30 | | | | | | 100 | A | SSS | A |
| 63 | 30 | | 70 | 60 | | | | | | 100 | A | SSS | A |
| 64 | 15 | | 85 | 75 | | | | | | 100 | A | SSS | A |
| 65 | 50 | | 50 | 30 | | | | | | 100 | B | SSS | A |
| 66 | 20 | | 80 | 55 | | | | | | 100 | B | SSS | A |

In all of samples 1 to 66, the discharge member 351 contains platinum, and, as the platinum content for samples 1 to 66, 45 wt. %, 48 wt. %, 50 wt. %, 60 wt. %, 75 wt. %, 80 wt. %, 85 wt. %, 87 wt. %, 88.5 wt. %, 90 wt. %, 90.5 wt. %, 91 wt. %, 94.5 wt. %, 95 wt. %, 98.5 wt. %, and 100 wt. % are indicated.

The discharge member 351 of sample 1 is 100 wt. % of platinum (pure platinum). In samples 2 to 64 excluding sample 1, the discharge member 351 contains at least one of rhodium (Rh), nickel (Ni), iridium (Ir), rhenium (Re), palladium (Pd), and gold (Au).

In samples 3, 6 to 10, 14 to 43 each of which contains rhodium, as a rhodium content, 5 wt. %, 10 wt. %, 20 wt. %, 40 wt. %, and 45 wt. % are indicated. In samples 11 to 13, 41 to 66 each of which contains nickel, as a nickel content, 1.5 wt. %, 5 wt. %, 10 wt. %, 12 wt. %, 15 wt. 5, 20 wt. %, and 25 wt. % are indicated. In samples 2, 4, 5 each of which contains iridium, an iridium content is 20 wt. %. In samples 9, 11, and 56 each of which contains rhenium, as a rhenium content, 8 wt. % and 10 wt. % are indicated. In samples 10, 19, 20 each of which contains palladium, as a palladium content, 4 wt. %, 8 wt. %, and 10 wt. % are indicated. In samples 12, 48 to 51, and 57 each of which contains gold, as a gold content, 4 wt. %, 8 wt. %, and 10 wt. % are indicated.

In samples 1, 2, 4 to 66 excluding sample 3, the intermediate member 353 contains platinum, and, as a platinum content, 15 wt. %, 20 wt. %, 30 wt. %, 40 wt. %, 50 wt. 5, 60 wt. %, 66 wt. 5, 68 wt. %, 80 wt. %, 85 wt. %, 89 wt. %, 90 wt. %, 91 wt. %, 92 wt. %, 93 wt. %, 93.5 wt. %, 95 wt. %, 96 wt. %, 97.5 wt. %, 98 wt. %, and 98.5 wt. % are indicated.

In samples 1, 3, 4, 7 to 66 excluding samples 2, 5, 6, the intermediate member 353 contains nickel, and, as a nickel content, 2 wt. %, 2.5 wt. %, 3 wt. %, 3.5 wt. %, 4 wt. %, 5 wt. %, 7 wt. %, 10 wt. %, 12 wt. %, 15 wt. %, 20 wt. %, 40 wt. %, 50 wt. %, 70 wt. %, 80 wt. %, 85 wt. %, 90 wt. %, and 99 wt. % are indicated.

The intermediate member 353 may further contain one or more of rhodium, iridium, palladium, gold, chromium (Cr), and cobalt (Co). In samples 13, 47, 55, 56, and 60 each of which contains rhodium, as a rhodium content, 3 wt. % and 5 wt. % are indicated. In samples 3, 12, 30, 32, 48 to 51, 57 each of which contains iridium, as an iridium content, 1 wt. %, 2 wt. %, 4 wt. %, and 5 wt. % are indicated. In samples 5, 26, 30, and 32 each of which contains palladium, as a palladium content, 2 wt. %, 4 wt. %, 5 wt. %, and 60 wt. % are indicated. In sample 2 that contains gold, a gold content is 20 wt. %. In samples 44, 45 each of which contains chromium, a chromium content is 5 wt. %. In samples 6, 13, 58, and 60 each of which contains cobalt, as a cobalt content, 1.5 wt. %, 4 wt. %, 15 wt. %, and 17 wt. % are indicated.

In samples 1 to 66, as the distance D1 from the diffusion layer 352 to the discharge surface 351B of the discharge member 351, 0.09 mm, 0.1 mm, 0.11 mm, 0.12 mm, 0.13 mm, 0.15 mm, 0.2 mm, 0.25 mm, 0.27 mm, 0.3 mm, and 0.38 mm are indicated. In addition, as the gap length G, 0.4 mm, 0.8 mm, 1 mm, 1.1 mm, 1.2 mm, 1.3 mm, and 1.4 mm are indicated. In addition, as the thickness D2 of the diffusion layer 352, 0.001 mm, 0.002 mm, 0.004 mm, 0.005 mm, 0.007 mm, 0.008 mm, 0.009 mm, 0.012 mm, 0.017 mm, 0.022 mm, 0.027 mm, 0.047 mm, 0.065 mm, and 0.075 mm are indicated.

Figure 4:
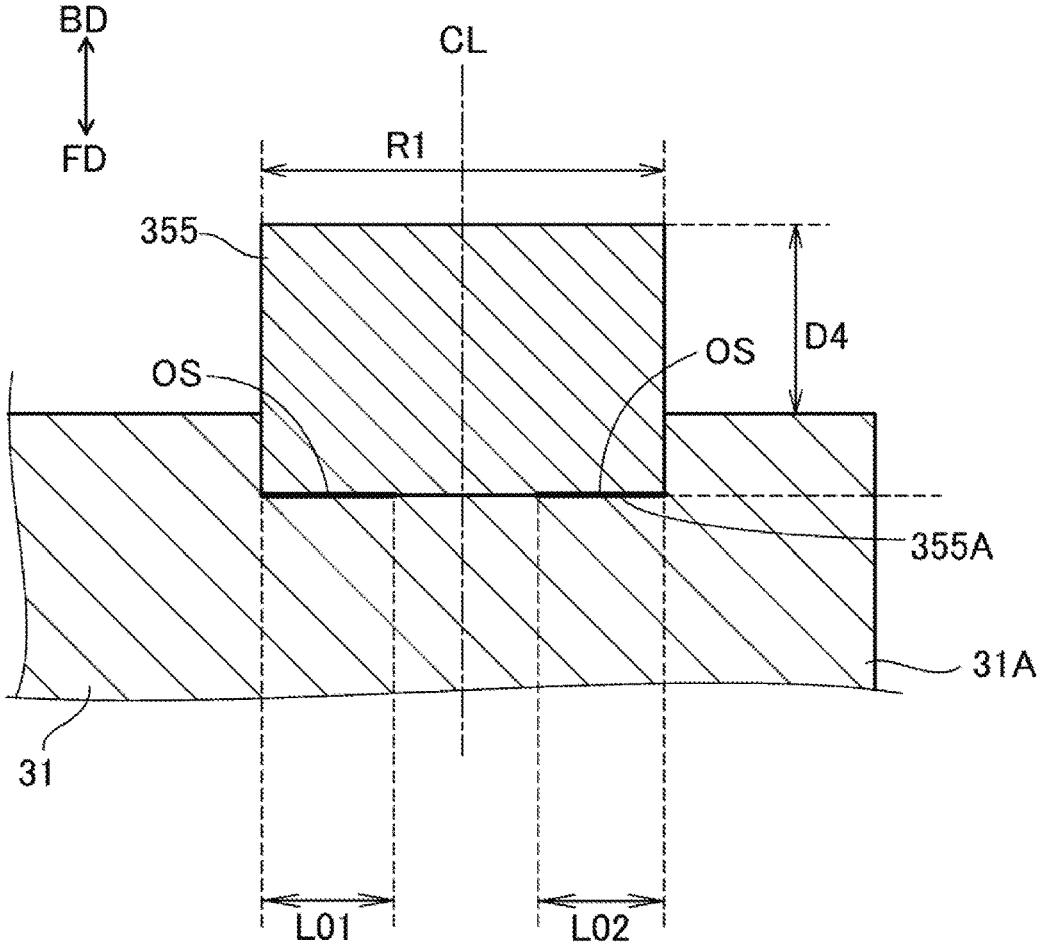
FIG. 4 is an explanatory view of a comparative sample.

It is noted that, for samples 1 to 66, comparative samples that correspond to the respective samples were prepared. FIG. 4 is an explanatory diagram of a comparative example. FIG. 4 is a cross-sectional view obtained by cutting a portion in the vicinity of the front end of the comparative example at a cross section including the axis CL. As shown in FIG. 4, in each comparative sample, an electrode tip 355 was prepared, and the electrode tip 355 had the same composition as the discharge member 351 of the corresponding sample and had the same shape and size as the entirety of the clad electrode 35 of the corresponding sample. Then, the comparative sample was manufactured by performing resistance welding of the electrode tip 355 in place of the clad electrode 35 of the corresponding sample, onto the ground electrode base material 31. The structure excluding the electrode tip 355 of the comparative sample, such as the gap length G and the projecting length D4, is the same as that of a corresponding one of samples 1 to 66.

In the evaluation test, durability test was performed in which each of the samples and the comparative samples was mounted to a 3-cylinder gasoline engine having a displacement of 0.66 L. In the durability test, driving at a rotation speed of 6000 rpm for one minute and driving in an idling state for one minute were repeatedly performed at full throttle over 150 hours. Then, driving at a rotation speed of 6000 rpm for 100 hours at full throttle was further performed. It is noted that conditions, such as a quantity of fuel injection, of this gasoline engine was adjusted, such that, when a spark plug having the same shape as that used in the test except that a thermocouple was mounted in the ground electrode was used, the temperature at a position which was distant, by 1 mm, toward the joint surface at which a metal shell was joined, from the front end of the spark plug (the front end of the ground electrode 30) was 1000° C. at full throttle.

After the durability test, regarding the discharge member 351 of each sample and the electrode tip 355 of each comparative sample, a decreased amount (hereinafter called consumed volume), after the test, by which the volume before the test has decreased, was measured by using a CT scanner (TOSCANER-32250 μhd manufactured by Toshiba IT & Control Systems Corporation). Then, the consumed volume of the discharge member 351 in the case of the consumed volume of the electrode tip 355 of the corresponding comparative sample being 1 was calculated as a consumed volume of each sample. Then, wear resistance of a sample for which the consumed volume was not more than 0.95 was evaluated as "C". Wear resistance of a sample for which the consumed volume was not less than 0.9 and less than 0.95 was evaluated as "B". Wear resistance of a sample for which the consumed volume was less than 0.9 was evaluated as "A". Wear resistance is superior in the order of A, B, and C.

Furthermore, the ground electrode 30 of each sample and comparative sample after the durability test was cut on the cross section including the axis CL, and the oxide scale generation proportion at the cross section was measured.

First, the comparative samples will be described. A case where oxide scale OS indicated by a bold solid line has been generated in a cross section of the comparative sample in FIG. 4, will be described. In the cross section in FIG. 4, oxide scale OS was generated at an interface having the entire length of R1 between the ground electrode base material 31 and a front end surface 355A of the electrode tip 355. On the interface, a length L0 of a part in which oxide scale OS was generated was measured. The length L0, in the example shown in FIG. 4, is a total of L01 and L02 (L0=L01+L02), and a ratio (L0/R) of the length L0 of a part in which oxide scale was generated relative to the entire length R1 of the interface was calculated as an oxide scale generation proportion SR0 of each comparative sample.

Next, the samples will be described. For each of the samples, the oxide scale generation proportion SR1 between the discharge member 351 and the intermediate member 353, and the oxide scale generation proportion SR2 between the intermediate member 353 and the ground electrode base material 31 were measured. Specifically, a length L1 (not shown) of a part in which oxide scale was generated between the front end surface 351A of the discharge member 351 and a front end surface 352A of the diffusion layer 352 was measured. Then, the length L1 with respect to the entire length R1 of the interface was calculated as the oxide scale generation proportion SR1 (SR1=(L1/R)) for each sample. Furthermore, a length L2 (not shown) of a part in which oxide scale was generated at the interface between the intermediate member 353 and the ground electrode base material 31 was measured. Then, the length L2 with respect to the entire length R1 of the interface was calculated as the oxide scale generation proportion SR2 (SR2=(L2/R1)) for each sample.

Then, the oxide scale generation proportion SR1 in the case of the oxide scale generation proportion SR0 of the corresponding comparative sample being 1 was calculated as an evaluation value E1 of peeling resistance 1 of each sample. Peeling resistance 1 means resistance to peeling between the discharge member 351 and the intermediate member 353. In addition, the oxide scale generation proportion SR2 in the case of the oxide scale generation proportion SR0 of the corresponding comparative sample being 1 was calculated as an evaluation value E2 of peeling resistance 2 of each sample. Peeling resistance 2 means resistance to peeling between the intermediate member 353 and the ground electrode base material 31.

Peeling resistance 1 of a sample in which the evaluation value E1 was not less than 0.95 or the oxide scale generation proportion SR1 was not less than 0.5 was evaluated as "C". Peeling resistance 1 of a sample in which the evaluation value E1 was not less than 0.9 and less than 0.95 and the oxide scale generation proportion SR1 was less than 0.5 was evaluated as "B". Peeling resistance 1 of a sample in which the evaluation value E1 was not less than 0.85 and less than 0.9 and the oxide scale generation proportion SR1 was less than 0.5 was evaluated as "A". Peeling resistance 1 of a sample in which the evaluation value E1 was not less than 0.5 and less than 0.85 and the oxide scale generation proportion SR1 was less than 0.5 was evaluated as "S". Peeling resistance 1 of a sample in which the evaluation value E1 was not less than 0.3 and less than 0.5 and the oxide scale generation proportion SR1 was less than 0.5 was evaluated as "SS". Peeling resistance 1 of a sample in which the evaluation value E1 was less than 0.3 and the oxide scale generation proportion SR1 was less than 0.5 was evaluated as "SSS". Resistance to peeling between the discharge member 351 and the intermediate member 353 is superior in the order of SSS, SS, S, A, B, and C.

Furthermore, peeling resistance 2 of a sample in which the evaluation value E2 was not less than 0.95, or the oxide scale generation proportion SR2 was not less than 0.5 was evaluated as "C". Peeling resistance 2 of a sample in which the evaluation value E2 was not less than 0.8 and less than 0.95 and the oxide scale generation proportion SR2 was less than 0.5 was evaluated as "B". Peeling resistance 2 of a sample in which the evaluation value E2 was less than 0.8 and the oxide scale generation proportion SR1 was less than 0.5 was evaluated as "A". Resistance to peeling between the intermediate member 353 and the ground electrode base material 31 is superior in the order of A, B, and C.

Results of the evaluation test are as indicated in Tables 1 to 4. In samples 7 and 8 in which the thickness D2 of the diffusion layer 352 was not within a range of not less than 0.002 mm to not more than 0.065 mm, although the material of the discharge member 351 satisfied the above-described (1) to (3) and the material of the intermediate member 353 satisfied the above-described (4) to (6), wear resistance and peeling resistance 1 were evaluated as "C". This may be because, as described above, it is not possible to suppress peeling due to thermal stress, or increase in thickness of the diffusion layer 352 due to progressing of diffusion.

In samples 1, 2, 4, 5, 9 to 12 in which the discharge member 351 did not satisfy any of the above-described (1) to (3), wear resistance and peeling resistance 1 were evaluated as "C". Especially, in samples 1, 4, 9, 11, and 12, although the thickness D2 of the diffusion layer 352 was within a range of not less than 0.002 mm to not more than 0.065 mm and the intermediate member 353 satisfied the above-described (4) to (6), wear resistance and peeling resistance 1 were evaluated as "C". This may be because, for example, in sample 1 in which the discharge member 351 was pure platinum, it is not possible to suppress the increase of the diffusion layer 352 due to the above-described intercrystalline cracking of platinum. In addition, in samples 2, 4, 5, 9 to 12 in which the total content of platinum, rhodium, and nickel in the discharge member 351 was less than 92 wt. %, it may not be possible to suppress increase in the proportion of an element (e.g., iridium) inferior in oxidation resistance and embrittlement of the diffusion layer 352 and decrease in thermal conductivity of the diffusion layer 352.

In samples 2, 3, 4, 5, 6, and 13 in which the intermediate member 353 did not satisfy any of the above-described (4) to (6), at least one of wear resistance, peeling resistance 1, and peeling resistance 2 was evaluated as "C". For example, in all of samples 2, 5, and 6 in which the intermediate member 353 did not contain nickel, peeling resistance 2 was evaluated as "C". This may be because, since the intermediate member 353 did not contain nickel, it is not possible to sufficiently decrease thermal stress between the intermediate member 353 and the ground electrode base material 31 containing nickel as a principal component. In addition, in sample 3 in which the intermediate member 353 did not contain platinum, peeling resistance 1 was evaluated as "C". This may be because, since the intermediate member 353 did not contain platinum, it is not possible to sufficiently decrease thermal stress between the intermediate member 353 and the discharge member 351. Furthermore, in all of samples 2, 5, and 13 in which the total content of platinum, rhodium, and nickel was less than 85 wt. %, wear resistance and peeling resistance 1 were evaluated as "C". Especially, in sample 13, although the discharge member 351 satisfied the above-described (1) to (3), the intermediate member 353 satisfied the above-described (4) and (5), and the thickness D2 of the diffusion layer 352 was within a range of not less than 0.002 mm to not more than 0.065 mm, wear resistance and peeling resistance 1 were evaluated as "C". This may be because, since the total content of platinum, rhodium, and nickel in the intermediate member 353 was less than 85 wt. %, it is not possible to suppress embrittlement of the diffusion layer 352 and decrease in thermal conductivity of the diffusion layer 352 as described above. In addition, in sample 5 in which both the platinum content and the nickel content in the intermediate member 353 were less than 50 wt. %, wear resistance, peeling resistance 1, and peeling resistance 2 were all evaluated as "C". This may be because it is not possible to suppress embrittlement of the diffusion layer 352 and decrease in thermal conductivity of the diffusion layer 352 as described above.

Meanwhile, in samples 14 to 66 in which the discharge member 351 satisfied the above-described (1) to (3), the intermediate member 353 satisfied the above-described (4) to (6), and the thickness D2 of the diffusion layer 352 was within a range of not less than 0.002 mm to not more than 0.065 mm, wear resistance, peeling resistance 1, and peeling resistance 2 were all evaluated as "B" or higher.

As is understood from the above description, it has been confirmed that in a case where the discharge member 351 satisfies the above-described (1) to (3), the intermediate member 353 satisfies the above-described (4) to (6), and the thickness D2 of the diffusion layer 352 is not less than 0.002 mm and not more than 0.065 mm, it is possible to achieve both wear resistance and peeling resistance in the spark plug 100.

In samples, among samples 14 to 66, which further satisfied one or more of the following (7) to (10), it has been found that resistance to peeling between the discharge member 351 and the intermediate member 353 was further improved.

(7) The thickness of the diffusion layer 352 is not less than 0.005 mm and not more than 0.065 mm.

(8) The distance D1 between the diffusion layer 352 and the discharge surface 351B of the discharge member 351, and the gap length G satisfy D1≥0.1 mm and (D1/G)≥0.1.

(9) In the discharge member 351, the total content of platinum, rhodium, and nickel is not less than 96 wt. %.

(10) In the intermediate member 353, the total content of platinum, rhodium, and nickel is not less than 96 wt. %.

It is noted that among samples 14 to 66, samples that satisfy the above-described (7) are samples 14, 15, 24 to 26, 28, 30 to 36, 38, 39, 41 to 43, 48, 50, 51, and 55 to 66. Among samples 14 to 66, samples that satisfy the above-described (8) are samples 16 to 43, 47, 51 to 59, and 61 to 66. Among samples 14 to 66, samples that satisfy the above-described (9) are samples 14 to 18, 20 to 48, 52 to 55, and 58 to 66. Among samples 14 to 66, samples that satisfy the above-described (10) are samples 14 to 31, 33 to 43, 46, 47, 52 to 59, and 61 to 66.

For example, among samples 14 to 66, peeling resistance 1 of sample 49 that does not satisfy any of the above-described (7) to (10) was evaluated as "B". Meanwhile, among samples 14 to 66, peeling resistance 1 of each of samples 44, 45, and 50 that satisfies only one of the above-described (7) to (10) was evaluated as "A". In addition, among samples 14 to 66, peeling resistance 1 of each of samples 19, 46, 48, 51, and 60 that satisfies two of the above-described (7) to (10) was evaluated as "S". In addition, among samples 14 to 66, peeling resistance 1 of each of samples 14 to 18, 20 to 23, 27, 29, 32, 37, 40, 47, 52 to 54, 56, and 57 that satisfies three of the above-described (7) to (10) was evaluated as "SS". Among samples 14 to 66, peeling resistance 1 of each of samples 24 to 26, 28, 30, 31, 33 to 36, 38, 39, 41 to 43, 55, 58, 59, and 61 to 66 that satisfies all of the above-described (7) to (10) was evaluated as "SSS".

Thus, it has been confirmed that it is more preferable that at least one of the above-descried (7) to (10) is satisfied. Thus, it is possible to further improve resistance to peeling between the discharge member 351 and the intermediate member 353.

Furthermore, among samples 14 to 66, peeling resistance 2 of each of samples 16 to 20, 44, 47, 58, and 60 in each of which the above-described ΔW(Ni) was less than 2.5 was evaluated as "B". Peeling resistance 2 of each of samples 14, 15, 21 to 43, 45, 46, 48 to 57, 59, and 61 to 66 in which ΔW(Ni) was not less than 2.5 was evaluated as "A".

Thus, it has been confirmed that it is more preferable that ΔW(Ni) is not less than 2.5, that is, that the nickel content in the intermediate member 353 is higher than the nickel content in the discharge member 351 by not less than 2.5 wt. %. Thus, it is possible to further improve resistance to peeling between the intermediate member 353 and the ground electrode base material 31.

Furthermore, among samples 14 to 66, wear resistance of each of samples 19, 42, 49 to 51, 56, 57, 65, 66 in which, in the discharge member 351, the total content of platinum and rhodium was less than 88 wt. %, or the total content of platinum, rhodium, and nickel was less than 96 wt. % was evaluated as "B". Wear resistance of each of samples 14 to 18, 20 to 41, 43 to 48, 52 to 55, and 58 to 64 in which, in the discharge member 351, the total content of platinum and rhodium was not less than 88 wt. %, and the total content of platinum, rhodium, and nickel was not less than 96 wt. % was evaluated as "A".

Thus, it has been confirmed that it is more preferable that, in the discharge member 351, the total content of platinum and rhodium is not less than 88 wt. % and the total content of platinum, rhodium, and nickel is not less than 96 wt. %. Thus, by decreasing, in the discharge member, the components other than platinum superior in wear resistance and rhodium which allows suppression of the grain growth of the platinum, it is possible to further improve wear resistance of a spark plug.

C. Modification (a) In the above-described embodiment, the ground electrode 30 and the center electrode 20 oppose each other in the axis CL direction of the spark plug 100, and form a gap (vacant space) to cause spark discharge. Instead thereof, the ground electrode 30 and the center electrode 20 may oppose each other in a direction perpendicular to the axis CL, and form a gap to cause spark discharge.

(b) In the above-described embodiment, the clad electrode 35 is used for the ground electrode 30. However, the clad electrode 35 may be used for the center electrode 20. That is, the clad electrode 35 may be welded to the front end surface of the leg portion 25 of the center electrode 20 by resistance welding.

(c) The materials of the general components of the spark plug 100 of the above-described embodiment, for example, the materials of the metal shell 50, the center electrode 20, and the ceramic insulator 10 can be variously changed. In addition, specific dimensions of the metal shell 50, the center electrode 20, and the ceramic insulator 10 can be variously changed. For example, the material of the metal shell 50 may be low-carbon steel that is plated with zinc or nickel, and may be unplated low-carbon steel. In addition, the material of the ceramic insulator 10 may be various insulating ceramics other than alumina.

Although the present invention has been described above based on the embodiments and the modified embodiments, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5: gasket
6: ring member
8: plate packing
9: talc
10: ceramic insulator
12: through hole
13: leg portion
15: step portion
16: step portion
17: front trunk portion
18: rear trunk portion
19: flange portion
20: center electrode
21: center electrode body
21A: electrode base material
21B: core portion
23: head portion
24: flange portion
25: leg portion
27: melt portion
29: center electrode tip
29A: discharge surface
30: ground electrode
31: ground electrode base material
35: clad electrode
40: metal terminal
41: cap mounting portion
42: flange portion
43: leg portion
50: metal shell
51: tool engagement portion
52: mounting screw portion
53: crimp portion
54: seat portion
56: step portion
58: compressive deformation portion
59: insertion hole
60: conductive seal
70: resistor
80: conductive seal
100: spark plug
351: discharge member
352: diffusion layer
353: intermediate member Having described the invention, the following is claimed:

1. A spark plug comprising:

a center electrode extending in an axial direction; and a ground electrode forming a gap between the ground electrode and the center electrode, wherein at least one of the center electrode and the ground electrode includes:

an electrode base material;

a discharge member having a discharge surface that forms the gap;

an intermediate member disposed between the discharge member and the electrode base material; and a diffusion layer formed between the discharge member and the intermediate member, the electrode base material contains not less than 50 wt. % of nickel (Ni), the discharge member contains not less than 45 wt. % of platinum (Pt), and at least one of nickel and rhodium (Rh), the intermediate member contains platinum and nickel, in the discharge member, a content of platinum is highest, and a total content of platinum, rhodium, and nickel is not less than 92 wt. %, in the intermediate member, a content of one of platinum and nickel is not less than 50 wt. %, a content of nickel is higher than a content of nickel in the discharge member, and a total content of platinum, rhodium, and nickel is not less than 85 wt. %, and a thickness of the diffusion layer is not less than 0.002 mm and not more than 0.065 mm.

2. The spark plug according to claim 1, wherein the thickness of the diffusion layer is not less than 0.005 mm and not more than 0.065 mm.

3. The spark plug according to claim 1, wherein in the case where D1 represents a distance between the diffusion layer and the discharge surface of the discharge member, and G represents a length of the gap, D1≥0.1 mm and (D1/G)≥0.1 are satisfied.

4. The spark plug according to claim 1, wherein in the discharge member, a total content of platinum, rhodium, and nickel is not less than 96 wt. %.

5. The spark plug according to claim 1, wherein in the intermediate member, a total content of platinum, rhodium, and nickel is not less than 96 wt. %.

6. The spark plug according to claim 1, wherein a content of nickel in the intermediate member is higher than a content of nickel in the discharge member by not less than 2.5 wt. %.

7. The spark plug according to claim 4, wherein in the discharge member, a total content of platinum and rhodium is not less than 88 wt. %.

* * * * *